US005788804A

United States Patent [19]

Hörsting

[11] Patent Number: 5,788,804

[45] Date of Patent: Aug. 4, 1998

[54] MACHINE FOR THE PRODUCTION OF PRE-READY MADE REINFORCEMENT FORMATIONS

[75] Inventor: Karl-Heinz Hörsting, Bayreuth, Germany

[73] Assignee: Liba Maschinenfabrik GmbH, Naila/Bayern, Germany

[21] Appl. No.: 683,098

[22] Filed: Jul. 16, 1996

[30] Foreign Application Priority Data

Jul. 17, 1995 [DE] Germany ..... 195 26 000.7
Jun. 21, 1996 [DE] Germany ..... 196 24 912.0

[51] Int. Cl.[6] ..... B32B 5/00

[52] U.S. Cl. ..... 156/440; 156/459; 156/177; 156/178; 156/179

[58] Field of Search ..... 156/440, 441, 156/459, 543, 177–179, 439, 436, 166, 176, 181; 19/160, 163, 301, 302; 28/101, 102, 100; 425/81.1, 83.1

[56] References Cited

U.S. PATENT DOCUMENTS 4,556,440 12/1985 Kreuger ..... 156/440
4,976,012 12/1990 McConnell ..... 28/101
5,242,520 9/1993 Carrier ..... 156/177
5,312,500 5/1994 Kurihara et al. ..... 156/181

FOREIGN PATENT DOCUMENTS 0 110 698 6/1984 European Pat. Off. .
2 592 404 12/1985 France .
691 11 183 4/1992 Germany .

*Primary Examiner*—Michael W. Ball
*Assistant Examiner*—Michael A. Tolin
*Attorney, Agent, or Firm*—Bardehle, Pagenberg, Dost, Altenburg, Frohwitter, Geissler

[57] ABSTRACT

A machine is described for the production of pre-man made-reinforcement formations especially having a thermoplastic matrix. The machine has a guiding-in device for reinforcement fibers and down-stream in the feeding direction there is a calender roller and thereafter is a winding device. At least in the area of the guiding-in device for the reinforcement fibers there is provided a needle track formed as a transport conveyor which serves as a fixation for the guided-in and deposited reinforcement fibers prior to being calendered.

14 Claims, 4 Drawing Sheets

MACHINE FOR THE PRODUCTION OF PRE-READY MADE REINFORCEMENT FORMATIONS

The invention is concerned with a machine for the production of pre-man made reinforcement formations having a duro/thermoplastic matrix.

[Faser-Kunstoff-Verbunde (FKV)], artificial fiber compounds have attained an ever increasing importance and they consist of fibers, fiber layers, woven, spread formations and others, which by way of a matrix can be bound together into a total and final compound. The fibers, threads, woven and other formations will herein after be designated as intermediate thread substances. These intermediate thread substances can be prewetted with a matrix whereby these prewetted intermediate substances can be inserted, as an example, into the SMC-(Sheet-Molding Compounds)-process which uses a duroplastic matrix. It could be inserted into the GMT-(Glass Mat reinforced Thermoplaste)-process which uses a thermoplastic matrix or it could be inserted into a prepreg process. With these artificial fiber bound compounds, the matrix must have a good adhesion with the fibers or the threads so that forces acting between the individual filaments can be transferred at their optimal value. A fault-free wetting is of special importance. As an example, adhered air bubbles can later result in the appearance of delaminations. It makes sense to pre-position the wetting section which determines the quality of the intermediate substances which are to be bound together relative to the working process. Such prewetted fiber formations are labeled as SMC-form masses, GMT-intermediate substances or so called Prepregs.

For the production of essentially flat compound products, so-called mat formations are inserted. Such a mat formation for SMC-form masses is principally described in "Introduction into the technology of fiber compound working materials, Michaeli/Wegener, Karl-Hanser-Verlag, Muenchen-Wien, 1989, p.17". With these mat formations, the ready mixed but still low viscosity resin is transferred to carrier foils. One of these carrier foils is then guided under a cutting device and then cut into small pieces, depending on the adjustment of the cutting device, which will now fall under the effect of gravity onto the raked foil. Thereby, an even distribution of the statically oriented glass fibers is obtained. By additionally depositing uncut rovings, form formations can be produced which show unidirectional reinforcements by way of quasi-endless glass fibers. These quasi-endless glass fibers are arranged in the feeding direction of the artificial fiber compound. In a following step, the second and also raked foil is transposed over the first foil. An intense mixing of the fibers with the resin mass is now obtained in a subsequent kneading section. A typical thickness of such a resin mat ranges from 2 to 3 mm. These resin mats are wound up after their production. After a certain curing time, through thickening of the original low viscosity resin mass, there is created a leather-like and gluey mat which, however, is not thread pulling.

In the GMT-process, a Polypropylene matrix is preferably being inserted. The production of GMT is carried out preferably on so-called double band presses in which the matrix is melted in an extruder and is inserted between two glass mats. Additionally, thermoplastic foils are guided in as cover layers. In order to obtain a better fiber-matrix through-wetting, the material initially is maintained at the level of the melting temperature and thereafter is cooled again under pressure.

In order to obtain higher strengths in the artificial fiber compounds, intermediate thread substances are introduced having multi-axial bindings. such multi-axial bindings can be produced on warp knitting machines with multi-axial warp insertion systems (System Liba).

The width of the binding being produced is limited by its thread tension, meaning, when a certain maximum width is exceeded, a slackening of the binding webs will occur which results in incorrect production exactnesses and to a shifting of the individual binding elements relative to each other.

Because of the thread tensions and because of the needle transport chain, relative thick side needles are necessary and therefore, especially during the warp insertion, the problem of so-called gutters appears. The formation of such gutters means that there is a lessening of the homogeneity of the material which includes losses in strengths. Especially, when inserting the reinforcing fibers, the problem of an exact force flow orientation of the reinforcing fibers takes on a deciding significance.

The depositing of the reinforcing threads into the intermediate thread structure can be obtained, for example, in the Malimo-process having shiftable group segments, wherein the shiftability in the Malimo-process is small.

From GB 1 042 134 there is known a machine for the production of pre-ready made reinforcement bindings wherein a web material is running between two bands having prongs thereon which hold the threads at a defined angle at their reversal points when they are deposited on the web material. Thereby, it is possible to deposit an array of threads that cross each other at certain angles and can be fixed there in a suitable manner. The transport band itself is not capable to hold the threads in a form locking manner.

From DE-OS 1 635 481 a machine is known for the production of non-woven products but having a woven appearance (right angle thread crossing). By way of this machine, a multitude of threads are deposited from a substantially vertical direction relative to the direction of the moving mat, wherein it is also possible to deposit the threads in a diagonal direction in order to be able to produce triangular stitches by means of an additional chain thread instead of the usual four corner stitches. In order to temporarily fixate the threads, a running web is introduced which consists of a textile web having a great multitude of microscopically small prongs. Such a textile web has the disadvantage in that when threads are to be deposited in an optional angle and in close proximity to each other they cannot be held in a defined position, which is especially required when the threads are to be deposited in a force flow oriented manner. Thereby, the microscopic prongs at most serve the purpose of depositing the threads in an even geometrical position and to temporarily fixate the same there. Under constant geometry, such a depositing is understood which either forms quadrangularor triangular stitches, that is, regular geometrical figures.

It is therefore an object of the invention to construct a machine for the production of pre-ready man made reinforcement formations especially having duroplastic or thermoplastic matrices and even though large widths are involved, a slackening of the intermediate thread substances is avoided and a depositing of the reinforcement fibers is made possible.

This object is achieved by way of a machine for the production of pre-man made reinforcement formations especially with a thermoplastic matrix, said machine comprising: a guiding device for reinforcement fibers, a thereafter arranged consolidation device, a winding device, and a transport conveyor of an intermediate fiber substance having means for holding the reinforcement fibers in a form-locked manner and in a defined position, wherein the transport conveyor comprises a needle track having protruding needles and wherein the transport conveyor feeds the intermediate fiber substance near the guiding device for the reinforcement fibers.

The machine for the production of pre-man made reinforcement formations having duro- or thermoplastic matrices according to the invention includes a feeding device for the reinforcement fibers, respectively reinforcement threads, and after the feeding of the reinforcement fibers there is a provision of a consolidation roller, or a double band pressing device, or a warp knitting machine for the reinforcement formation. In the area of the feeding device for the reinforcement fibers and preferably under the intermediate thread substance, there is the arrangement of at least one transport conveyer which is formed as a needle track having macroscopic needles protruding therefrom which carries the reinforcement fibers and feeds the same prior to a calendering or a knitting operation. Thereby, any slackening of the reinforcement fibers is avoided whereby it is quite possible, with corresponding wide needle tracks, to realize formation widths up to 3.5 m. Preferably, there is a provision of a feeding device for the intermediate thread substance. The intermediate thread substances which can be impregnated with a Duroplast or a Thermoplast (Prepreg fibers) are (pre) consolidated by an artificial material technical device, for example, a calender which is arranged prior to the winding device.

An additional advantage consists in the production of thermoplastic Prepregs in that a knitting unit for the knitting of the intermediate thread substances can be omitted because the calender, respectively the consolidation device, serves for the fixation of the intermediate thread substances.

For a corresponding support of the intermediate thread substances over their entire widths, a needle track is arranged throughout the whole width or several needle tracks are arranged adjacent each other and at the same height under the intermediate thread substances.

In order to avoid creating production induced tensions in the artificial fiber material compounds, in a further embodiment, the needle track and the calender roller device are preferably driven synchronously. In order that the reinforcement fibers which are being fed to the material and to be introduced therein, are being deposited in a force flow oriented manner on the transport conveyor, the feeding device for the reinforcement fibers is shiftably arranged normal to the feeding direction of the intermediate fiber substance.

Further advantages and applicabilities of the invention are now described below by having reference to the drawings.

DETAILED DESCRIPTION OF THE DRAWINGS

Figure 1:
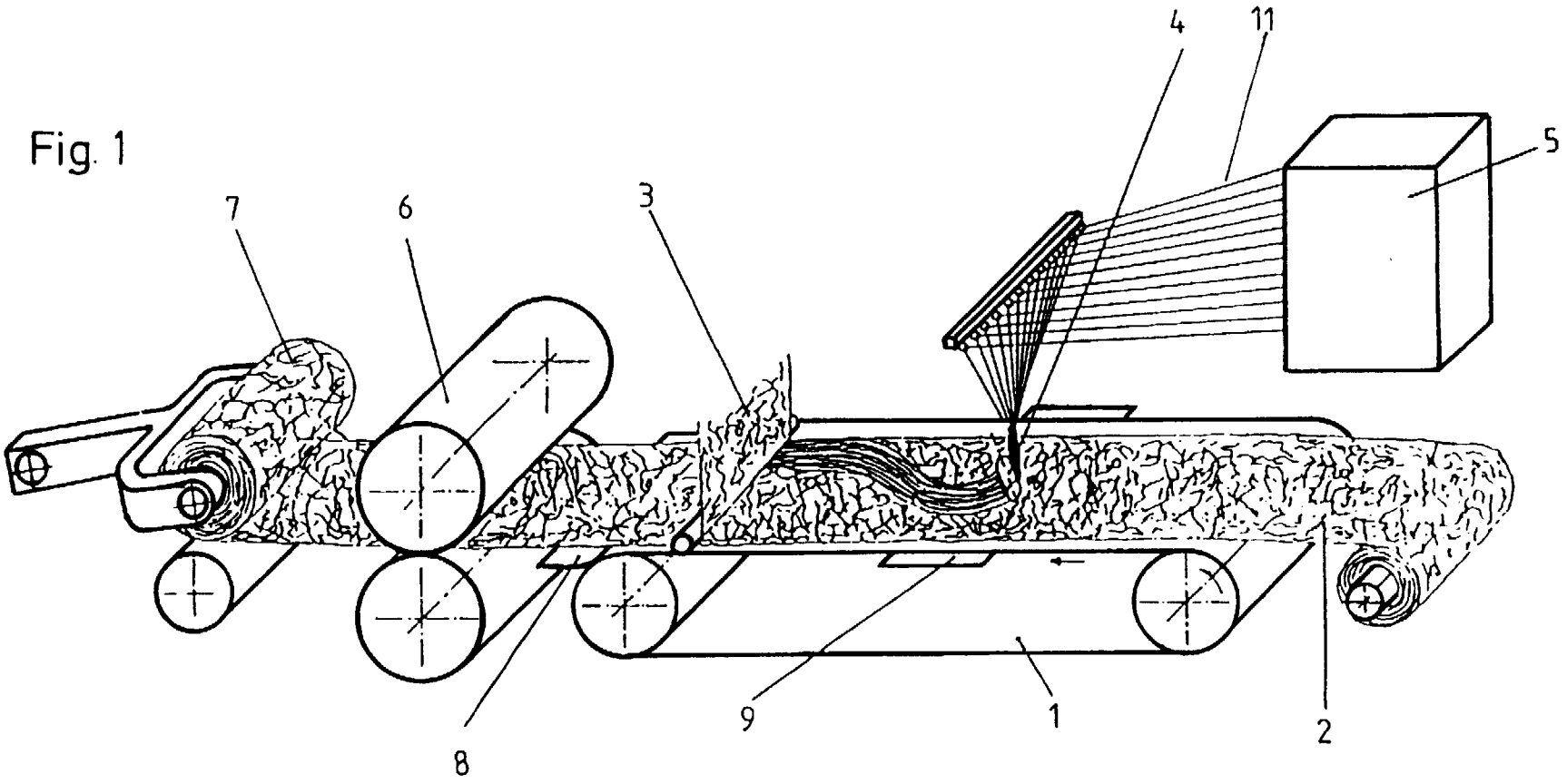
FIG. 1 shows a principal machine layout including a system according to the invention for the production of pre-man made reinforcement formations having a thermoplastic matrix.

In FIG. 1 there is illustrated the preferred embodiment of the laying system for the production of pre-man made reinforcement formations according to the invention herein involving a intermediate fiber substance shaving a thermoplastic matrix therein with intermediate fiber substance 2 running over needle track 1 which acts as a transport conveyor because it supports the intermediate fiber substance 2 over its total width and because of the multiple needles 12 attached to the side facing the intermediate fiber substance. In the area of the needle track 1 a movable laying unit 4 is provided which is mounted on a rod arranged normal to the feeding direction of intermediate fiber substance 2 with the laying unit having a grating 5 thereon through which reinforcement threads are fed, for example, glass fiber rovings 11. The needles 12 arranged on needle track 1 serve for the fixation of the reinforcement threads 11. Because the laying unit 4 is shiftable normal to the feeding direction of the vlies, the reinforcement threads can be deposited according to the oriented flow of force in the Prepreg product 10 and used later in the end product. In order to prevent a bending of intermediate fiber substance 2 when pressing the reinforcement threads onto the needle track by way of a roller 13, a counter pressure sheet metal plate 9 is provided in the area of the laying unit 4 under needle track 1 as a counter pressure device. Thereafter, a roller 15 is provided for driving the needle track 1 and thereby the intermediate fiber substance 2 in its feeding direction and there is provided a pressure roller around which a further intermediate fiber substance 3 is guided and pressed against the deposited reinforcement threads to fixate the same.

In order to avoid that the circulating needle track 1 and the intermediate fiber substance 2 carried by its needles runs around the driving roller, a stripping device 8 is provided. Of course, the vlies includes the intermediate fiber substance 2, the reinforcement threads 11 and the intermediate fiber substance 3. This stripping device 8 prevents the loose compound material consisting of the intermediate fiber substances 2 and 3 and the reinforcement threads 11 sandwiched there between from running around the driving roller 15 and the return roller 14, respectively. From the stripper 8, the relative loose material is guided to the calender 6 which consists of two heating rollers. By way of these rollers the heat is transferred to the material which has the effect of fusing the material so that the side after the calender represents a prepreg-product which has been created and is now wound up by a winding device.

Figure 2:
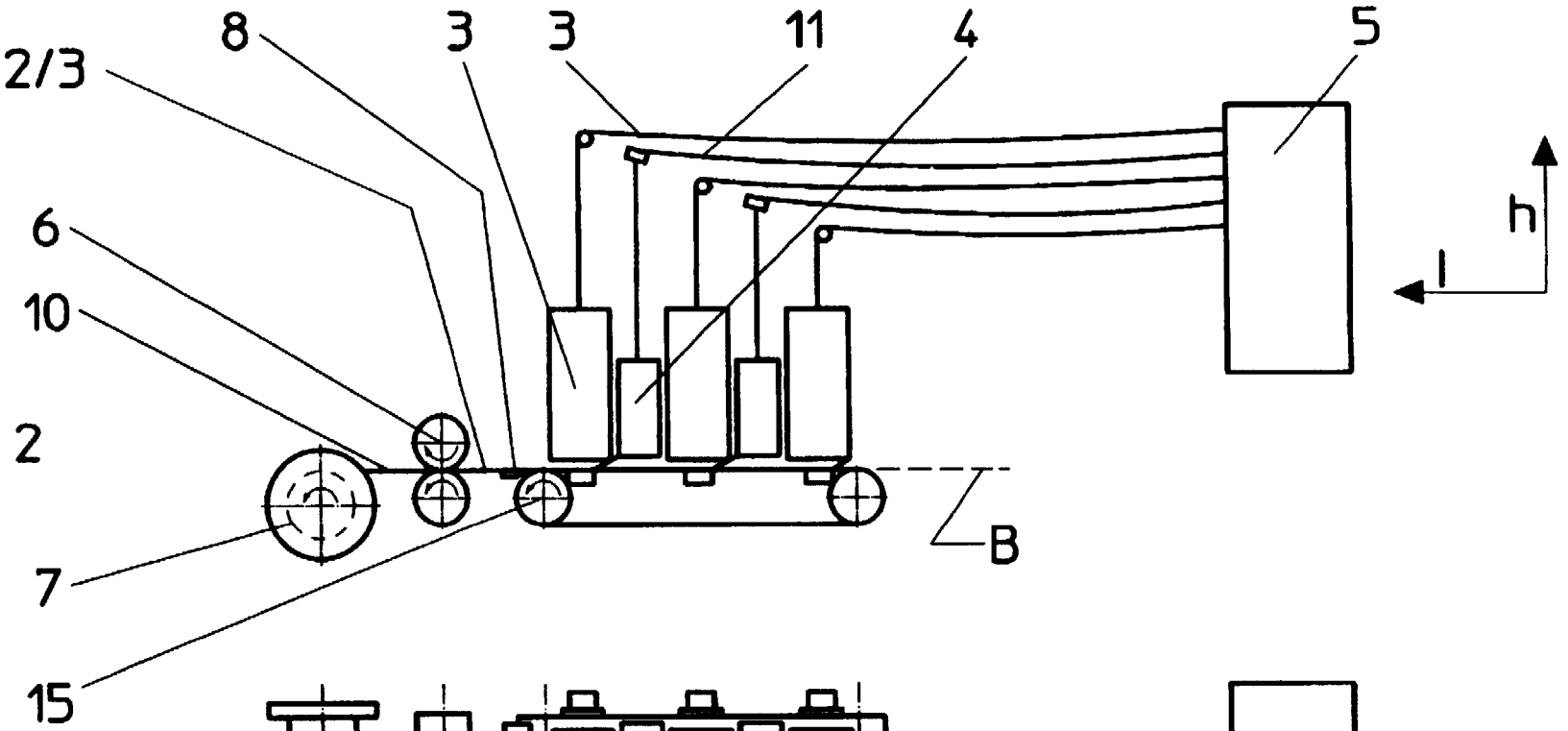
FIG. 2 shows the principal machine flow layout for the production of pre-man made reinforcement formations according to the invention.

FIG. 2 shows in principal the machine flow layout of the main parts of the machine in a side view according to the invention. With reference to the illustrated reference plane B, an intermediate thread substance advances in this plane toward the needle track 1 which is carried by drive roller 15 and the return roller 14. The intermediate fiber substance 2 is now deposited onto the needle track in the feed direction immediately after return roller 14 and continues to be fed in the feed direction. In the feed direction thereafter, there is a depositing of reinforcement threads 11 onto the thread intermediate layer which is feeding in the reference plane B. The reinforcement threads 11 are guided through unit 4. In order to prevent a bending of the needle track, there is provided under each corresponding feeding unit a counter pressure sheet metal plate 9.

In a further device for depositing glass rovings, reinforcement threads are deposited onto the intermediate thread layer having previously already received glass rovings. The layer of reinforcement threads is independent from the glass roving layer. Instead of the second layer of reinforcement threads or in addition thereto, a laying system for intermediate fiber substance 3 can be provided having corresponding presser rollers and a corresponding counter pressure device 9 thereunder. After the drive roller 15 for the needle track 1, there is a stripper 8 which assures a sure run-on to the calender rollers 6. The temperature of the calender rollers 6 is adjusted in such a manner that a consolidation bond is established between the intermediate fiber substances and the matrix. From the calender rollers, respectively the consolidation rollers 6, this Prepreg product 10 arrives at the winding device 7.

Figure 3:
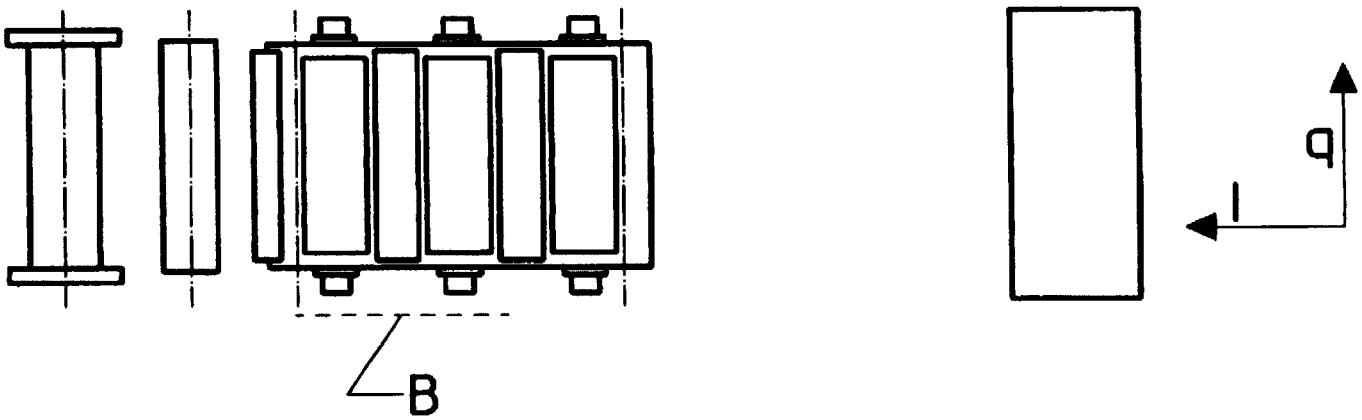
FIG. 3 shows a top view of the principal arrangement of the main machine parts according to FIG. 2 without the intermediate thread substance and reinforcement threads.

FIG. 3 is a top view of the in FIG. 2 described lay out without illustrating the inserted materials, that is, the intermediate thread substances and the guided reinforcement threads.

Figure 4:
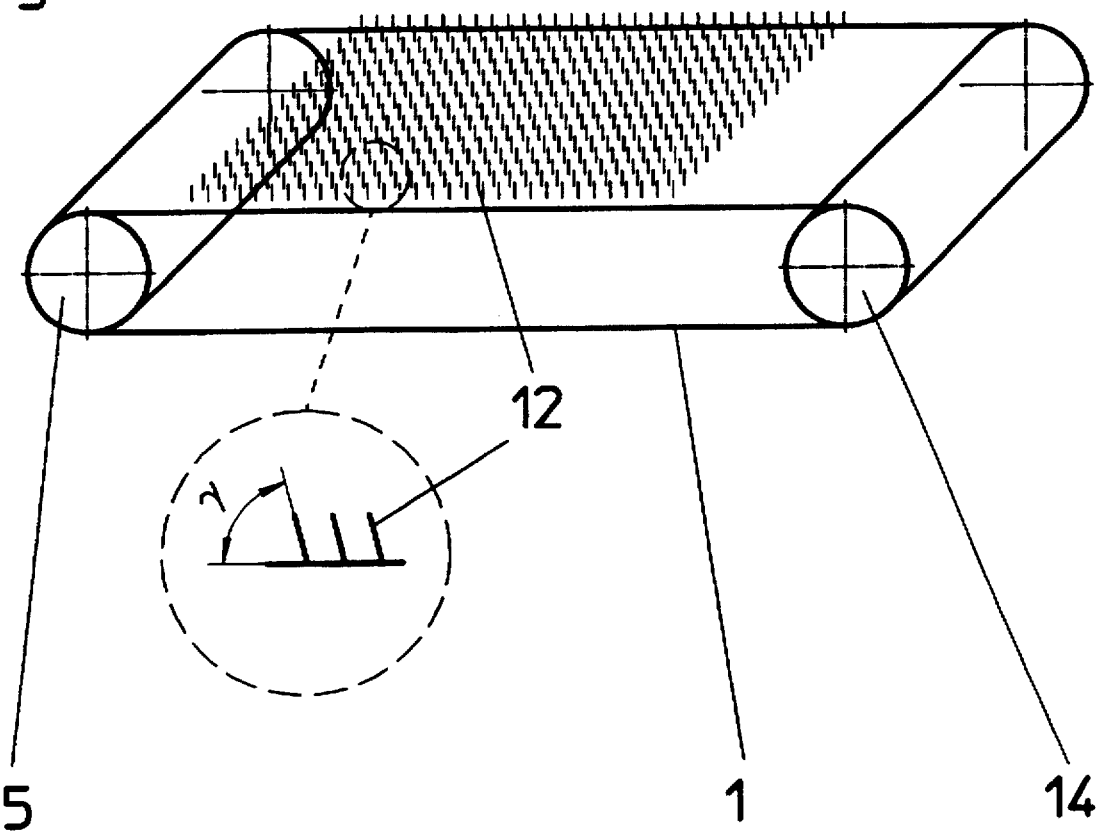
FIG. 4 shows the principal structure of a needle track.

In FIG. 4 the principal arrangement of a needle track according to the invention is illustrated. The needle track includes a width which is sufficient for a complete support of the guided in intermediate fiber substance 2, (see FIG. 1). The needle track 1 is driven by a drive roller 15 and at some distance a return roller 14 is arranged so that the needle track 1 revolves around both rollers 14 and 15 as an endless conveyor band. On the side of the transport band facing outwardly, that is, the side facing the intermediate fiber substance (see FIG. 1) relative to the machine layout, the needle track shows a multitude of needles 12 being spaced relatively even to each other. In order to assure a better feeding of the intermediate fiber substance 2 by the needles, the needles are inclined forwardly relative to the feed direction with a definite angle. It all depends upon demand, but any desirable width of such a needle track can be placed in operation.

Preferably, the width of the needle track does not exceed a width of 3 m. The distance of the needles relative to each should be advantageously about 1 to 3 mm but could assume a greater distance as it is dependent upon the intermediate fiber substance.

In order to obtain a sure depositing of the reinforcement fibers onto the needle track, the needles have a height of $\geqq 3$ mm. By having such a needle height, it is possible to fixate the reinforcement fibers, having commonly varying thicknesses, on the needle track, whereby the distance of the needles relative to each other is controlled by the exactness, relatively, the obtainable bending and taken into consideration the thread thickness. The smaller the distance of the needles relative to each other, the more exact the reinforcement fibers can be deposited in a force flow manner. On the other hand, the maximal thickness decreases in a narrow needle arrangement during which the reinforcement fibers can be deposited in the interstices between the needles in a reliable manner.

Figure 5:
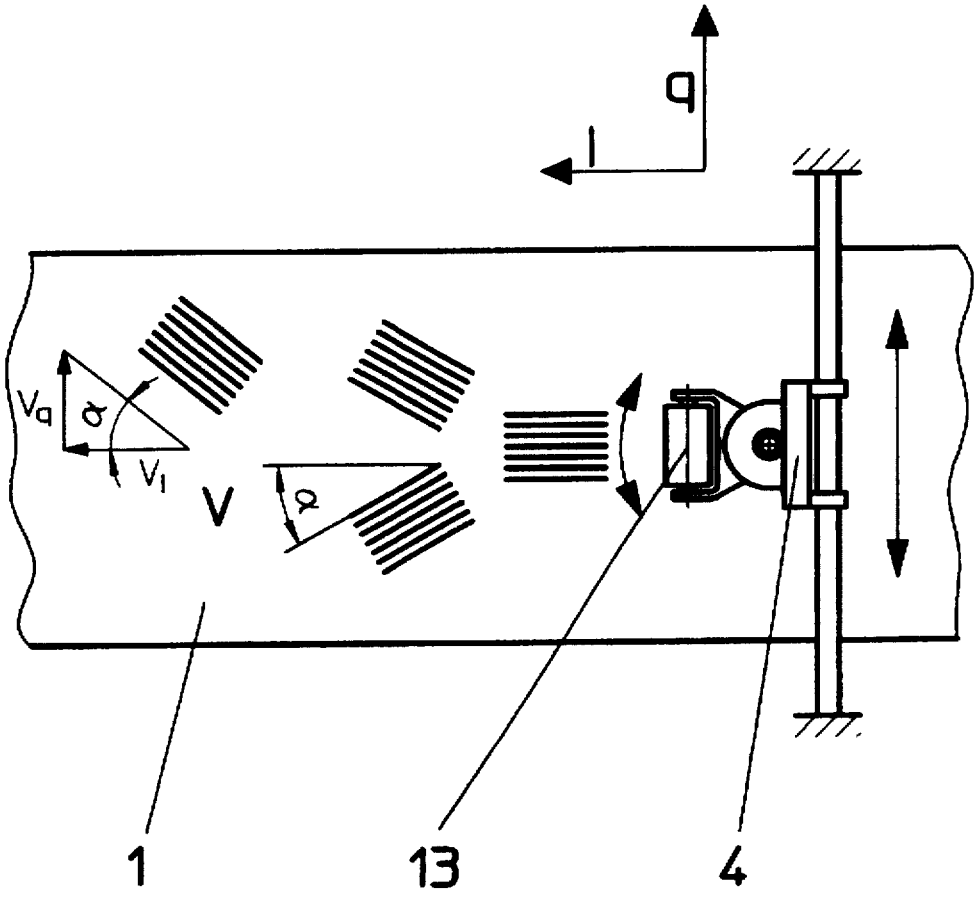
FIG. 5 shows the arrangement of a laying carriage above the needle track to obtain the various orientations of the reinforcement threads.

FIG. 5 shows a principal arrangement of a laying carriage or a laying unit 4 by which the laying principle of the reinforcement threads 11 in different orientations can be obtained. In order to obtain an orientation of the reinforcement threads 11, which deviates from the feeding direction of the product being produced, the laying carriage 4 including the delivery device for the reinforcement threads 11 is being moved in one direction which is substantially vertical to the feeding direction of the prepreg products and substantially parallel thereto. At the same time a depositing roller 13 which is mounted on the carriage 4 can be pivoted. Thereby, different angles can be created. Through a corresponding predetermined movement of the laying carriage 4 normal to the feed direction in connection with the feed speed of the prepreg products, one can obtain any desirable deposit angles for the reinforcement threads 11 so that the proffered device obtains a force flow oriented depositing of the reinforcement threads 11 onto the intermediate substance layer.

Under the definition of "force flow oriented depositing" it is understood that the reinforcing fibers are so arranged on the needle track so that they through the needle track fixated positions will receive as well as maintain that position within an artificial fiber compound which correspond to the force flow lines that are further propagated into later building units and into their force lines. At the same time, under the definition of "force flow oriented depositing" it is understood that the reinforcement fibers are deposited in such a manner that makes it possible to reinforce later building units especially around openings, that is, in the margins that face the openings. Thereby, the described process or the device for carrying out the process is easily useful for artificial fiber compounds where defined openings and break-throughs are already provided in the intermediate production products wherein the margin of the openings is reinforced by means of the reinforcing fibers. Thereby, a manifold of applications of the invention can be visualized for the artificial fiber compounds which can be produced by the process of the invention and the device for carrying out the process. An essential area of an application for the thus produced building units is in the production of automobile vehicle bodies which naturally already show many openings.

Of course, it also possible to control the guiding device 4 for the reinforcement fibers in such a manner that the reinforcement fibers are arranged within the confines of the artificial fiber compounds so that after working of the semifinished product, the same can be bodily installed in a spatial building unit as an end product.

What we claim is:

1. A machine for the production of pre-man made reinforcement formations especially with a thermoplastic matrix, said machine comprising: a guiding device for reinforcement fibers, a thereafter arranged consolidation device, a winding device, and a transport conveyor of an intermediate fiber substance having means for holding the reinforcement fibers in a form locked manner and in a defined position, wherein the transport conveyor comprises an endless conveyor band with a needle track having protruding needles and wherein the transport conveyor feeds the intermediate fiber substance near the guiding device for the reinforcement fibers.

2. A machine according to claim 1, wherein the guiding device for the reinforcement fibers is shiftable variably relative to a feed direction of the intermediate fiber substance and comprises a means for depositing the reinforcement fibers relative to the product to be produced in a form-locked manner.

3. A machine according to claim 1, wherein the needles are essentially evenly spaced from each other.

4. A machine according to claim 1, wherein the needles are inclined forwardly in a feed direction of the intermediate fiber substance.

5. A machine according to claim 1, wherein the needle track and the consolidation device are driven synchronously.

6. A machine for the production of pre-man made reinforcement formations especially with a thermoplastic matrix, said machine comprising: a guiding device for reinforcement fibers, a thereafter arranged consolidation device, a winding device, and a transport conveyor of an intermediate fiber substance having means for holding the reinforcement fibers in a form-locked manner and in a defined position, wherein the transport conveyor comprises an endless conveyor band with a needle track having protruding needles and wherein the transport conveyor feeds the intermediate fiber substance near the guiding device for the reinforcement fibers, wherein the width of the needle track extends over the total width of the intermediate fiber substance.

7. A machine according to claim 1, wherein at least two needle tracks are arranged adjacent to each other and at the same height and below the intermediate fiber substance.

8. A machine according to claim 1, further comprising a device for guiding-in the intermediate fiber substance.

9. A machine according to claim 2, further comprising a device for guiding-in the intermediate fiber substance.

10. A machine according to claim 3, further comprising a device for guiding-in the intermediate fiber substance.

11. A machine according to claim 4, further comprising a device for guiding-in the intermediate fiber substance.

12. A machine according to claim 5, further comprising a device for guiding-in the intermediate fiber substance.

13. A machine according to claim 6, further comprising a device for guiding-in the intermediate fiber substance.

14. A machine according to claim 7, further comprising a device for guiding-in the intermediate fiber substance.

* * * * *